US008733112B2

(12) United States Patent
Hon et al.

(10) Patent No.: US 8,733,112 B2
(45) Date of Patent: May 27, 2014

(54) STIRLING CYCLE CRYOGENIC COOLER WITH DUAL COIL SINGLE MAGNETIC CIRCUIT MOTOR

(75) Inventors: Robert C. Hon, Playa Del Rey, CA (US); Lowell A. Bellis, Long Beach, CA (US); Cyndi H. Yoneshige, Huntington Beach, CA (US)

(73) Assignee: Raytheon Company, Waltham, MA (US)

( * ) Notice: Subject to any disclaimer, the term of this patent is extended or adjusted under 35 U.S.C. 154(b) by 1404 days.

(21) Appl. No.: 11/805,320

(22) Filed: May 16, 2007

(65) Prior Publication Data

US 2008/0282706 A1 Nov. 20, 2008

(51) Int. Cl.

| | |
|---|---|
| ***F25B 9/00*** | (2006.01) |
| *F25B 9/14* | (2006.01) |
| *F25B 21/00* | (2006.01) |

(52) U.S. Cl.

CPC ... *F25B 9/00* (2013.01); *F25B 9/14* (2013.01); *F25B 21/00* (2013.01); *F25B 2309/001* (2013.01); *F25B 2321/0021* (2013.01)

USPC ..... 62/6

(58) Field of Classification Search

USPC ..... 62/6; 310/23, 24, 33, 34, 113, 115; 318/437; 60/517, 518, 519, 520

See application file for complete search history.

(56) References Cited

U.S. PATENT DOCUMENTS

| | | | | | |
|---|---|---|---|---|---|
| 4,227,100 | A | * | 10/1980 | Ezekiel et al. | 310/13 |
| 4,397,155 | A | * | 8/1983 | Davey | 62/6 |
| 4,824,122 | A | * | 4/1989 | Raj et al. | 277/410 |
| 5,088,288 | A | * | 2/1992 | Katagishi et al. | 62/6 |
| 5,678,409 | A | * | 10/1997 | Price | 62/6 |
| 5,907,201 | A | * | 5/1999 | Hiterer et al. | 310/30 |
| 6,141,971 | A | * | 11/2000 | Hanes | 62/6 |
| 6,167,707 | B1 | | 1/2001 | Price et al. | |
| 6,460,347 | B1 | * | 10/2002 | Fujiyama et al. | 62/6 |

FOREIGN PATENT DOCUMENTS

| | | | |
|---|---|---|---|
| DE | 38 36 959 | A1 | 5/1990 |
| EP | 0 070 780 | A | 1/1983 |
| JP | 60 243351 | A | 12/1985 |
| JP | 61 153348 | A | 7/1986 |
| JP | 04 217753 | A | 8/1992 |
| JP | 08 005178 | A | 1/1996 |
| JP | 2004 068662 | A | 3/2004 |
| JP | 2007 298219 | A | 11/2007 |

OTHER PUBLICATIONS

Stolfi, F. R. et al, Parametric Testing of a Linearly Driven Stirling Cryogenic Refrigerator, Proceedings Cryocooler Conference, Boulder, Sep. 17-18, 1984.
Vol Conf 3, No. 1984, Sep. 17, 1984, pp. 80-98, XP000041824.

* cited by examiner

*Primary Examiner* — Frantz Jules
*Assistant Examiner* — Keith Raymond

(57) ABSTRACT

Described herein is a Stirling cycle cryogenic cooler comprising: a first magnetic circuit and a second magnetic circuit for generating a field of magnetic flux; the first magnetic circuit and the second magnetic circuit having a shared magnetic gap and the first magnetic circuit further having an additional magnetic gap; a first coil disposed in the shared magnetic gap; and a second coil disposed in the additional magnetic gap, said second coil being mounted for independent movement relative to said first coil. Also described herein is a method of cooling using the Stirling cycle cryogenic cooler.

20 Claims, 6 Drawing Sheets

STIRLING CYCLE CRYOGENIC COOLER WITH DUAL COIL SINGLE MAGNETIC CIRCUIT MOTOR

BACKGROUND OF THE INVENTION

1. Field of the Invention

The present invention relates to cryogenic coolers. More specifically, the present invention relates to linear Stirling cycle cryogenic coolers.

2. Description of the Related Art

For certain applications, such as space infrared sensor systems, a cryogenic cooling subsystem is required to achieve improved sensor performance. Numerous types of cryogenic cooling subsystems are known in the art, each having relatively strong and weak attributes relative to the other types. Stirling and pulse-tube linear cryocoolers are typically used to cool various sensors and focal plane arrays in military, commercial, and laboratory applications. Both types of cryocoolers use a linear-oscillating compressor to convert electrical power to thermodynamic PV power. The implementation of the compression/expansion cooling cycle differs between the two and each type has advantages and disadvantages that make one or the other ideal for a given application.

Long life Stirling-class cryocoolers generally contain a minimum of two linear-oscillating motors, one of which drives a compressor while the other drives the Stirling-displacer. In practice, a total of 4 motors are typically included to provide necessary mechanical balancing and symmetry. Each motor generally consists of a magnetic circuit and a driven motor coil that is mounted on a moving, spring-supported bobbin. The magnetic circuits are typically very heavy due to their composition of steel and rare earth magnets. The physical size of the magnetic circuits varies with cryocooler capacity, however they are typically several inches in diameter and length. Hence, the need for separate magnetic circuits for each coil of a Stirling machine necessitates larger system mass and volume relative to pulse-tube type cryocoolers that do not contain a Stirling displacer motor. By comparison, the drive coils are very lightweight and small in all dimensions; the bulk of the mass and volume penalty resulting from the Stirling displacer motor is therefore associated with the magnetic circuit as opposed to the coil.

In any event, the advantage of Stirling-class cryocoolers is that they are generally more efficient than pulse-tube type cryocoolers, particularly at very low temperatures and over widely varying operating conditions. This is principally due to the fact that Stirling cryocoolers contain a moving Stirling displacer piston that can be actively driven to optimize the gas expansion phase angle, a parameter critical to the underlying thermodynamic cycle. For more on Stirling cryocoolers, see U.S. Pat. No. 6,167,707, entitled SINGLE-FLUID STIRLING PULSE TUBE HYBRID. EXPANDER, issued Jan. 2, 2001 to Price et al. the teachings of which are incorporated herein by reference.

Pulse tubes rely on purely passive means to control this phase angle such that no active control is possible. The efficiency and operational flexibility of the Stirling cryocooler comes at the cost of increased system mass and volume, parameters that many applications are extremely sensitive to. Hence, although Stirling-class cryocoolers are generally more efficient and operationally flexible (efficient over a much wider range of operating conditions) than pulse-tube cryocoolers, their increased mass and volume lessen their appeal in many applications.

In the past, tactical Stirling cryocoolers have partially overcome these downfalls through a design that uses compressor pneumatic pressure to drive the Stirling displacer piston; no magnetic structure or coil is required for the displacer piston in this design. However, this scheme has a serious drawback of its own: the lack of a Stirling displacer piston motor precludes any type of active control of the displacer piston. Its movement is determined solely by the thermodynamics of the system.

This is significant because the ability to actively control the stroke length and phase of the Stirling displacer piston (relative to the compressor piston) is essential to the efficient operation of the cryocooler. For example, given a certain heat load, cold-tip temperature and frequency, the displacer piston will need to be operated at a specific stroke length and phase in order for the system to operate at maximum efficiency. If any of these operational parameters change (cold tip temperature, system frequency, etc), it is likely that the optimum displacer stroke length and phase will change as well.

A Stirling cryocooler with a passive displacer piston can therefore be designed for peak efficiency at a single point of operation. In a similar manner to that of a completely passive pulse-tube cryocooler, the tactical cooler's efficiency will decrease significantly if any of its operating parameters are changed. Changes of this type are very common in a large number of cryogenically cooled applications. Hence, passive-displacer Stirling cryocoolers are often ill suited for use.

Other than a complete elimination of the Stirling displacer motor in some tactical cryocooler designs, no known serious attempts have been made to negate the mass and volume penalty associated with Stirling cryocoolers. While sound mechanical and packaging design practices have been used to help minimize the penalty, Stirling-class cryocoolers are generally much heavier and more voluminous than comparable capacity pulse-tube cryocoolers.

Hence, a need remains in the art for a system or method for reducing the mass and volume associated with Stirling cycle cryogenic coolers.

SUMMARY OF THE INVENTION

The need in the art is addressed by the Stirling cycle cryogenic cooler of the present invention. In the illustrative embodiment, the inventive cooler includes a single magnetic circuit for generating a field of magnetic flux in two separate air gaps; a first coil disposed in one magnetic air gap, and a second coil disposed in the other magnetic air gap.

In a specific embodiment, the first coil is a compressor coil and the second coil is a displacer coil. The first and second coils are mounted for independent movement. The coils are energized with first and second variable sources of electrical energy in response to signals from a controller.

Hence, the invention provides a method and mechanism for eliminating one of the magnetic circuits in a conventional Stirling cryocooler. A single magnetic circuit is used to drive both of the necessary separately moving coils (compressor and displacer). Inasmuch as the bulk of motor mass is due to the magnetic circuit, the total motor mass for this type of Stirling-cryocooler should be only slightly more than that of a typical comparable pulse-tube cryocooler.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
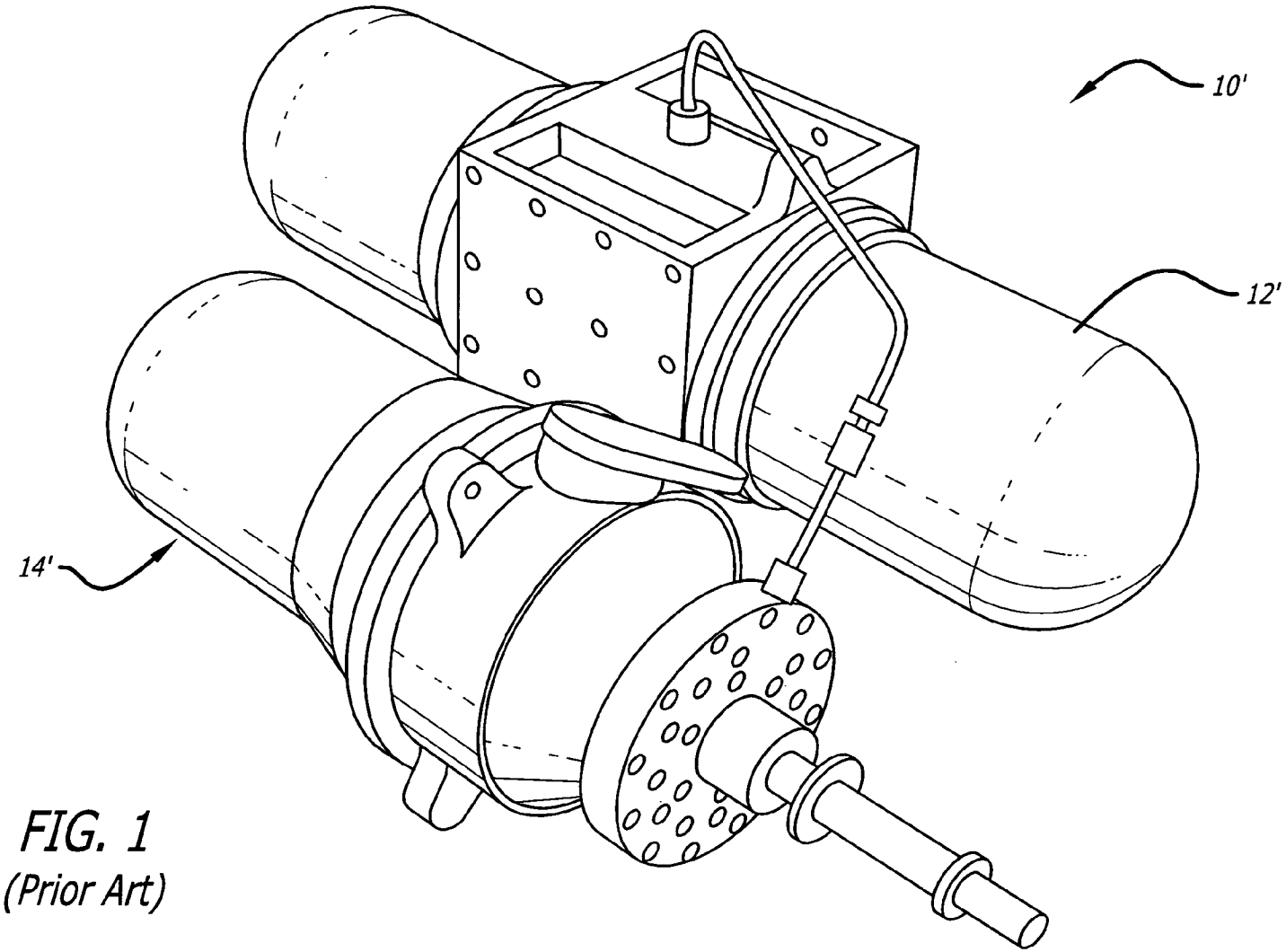
FIG. 1 (Prior Art)
FIG. 1 is a perspective view of a typical two-module Stirling-cycle cryocooler implemented in accordance with conventional teachings.

FIG. 1 is a perspective view of a typical two-module Stirling-cycle cryocooler implemented in accordance with conventional teachings. As illustrated in FIG. 1, a typical Stirling-class cryocooler 10' is typically composed of two separate modules. The first module is a compressor module 12'. This module typically contains one or more internal, linear motors (not shown) that convert electrical power to thermodynamic PV power for use in the expansion/compression cooling cycle. Each motor is a coil that moves in response to the interaction of coil current and a flux generated by a magnetic circuit. Though a single motor could be used to accomplish this compression, dual-opposed motors are usually employed in order to minimize vibration that would otherwise be emitted from a single, unbalanced piston. The expansion/compression cooling cycle takes place in the second module 14'. The second module is an expander module. This module also typically contains dual-opposed motors. One of the two expander module motors drives a Stirling displacer piston while the other motor is dedicated to balancing the displacer piston motor in order to minimize vibration. In all, the typical Stirling-class space cryocooler employs four separate motors for thermodynamic and vibration canceling purposes.

Figure 2:
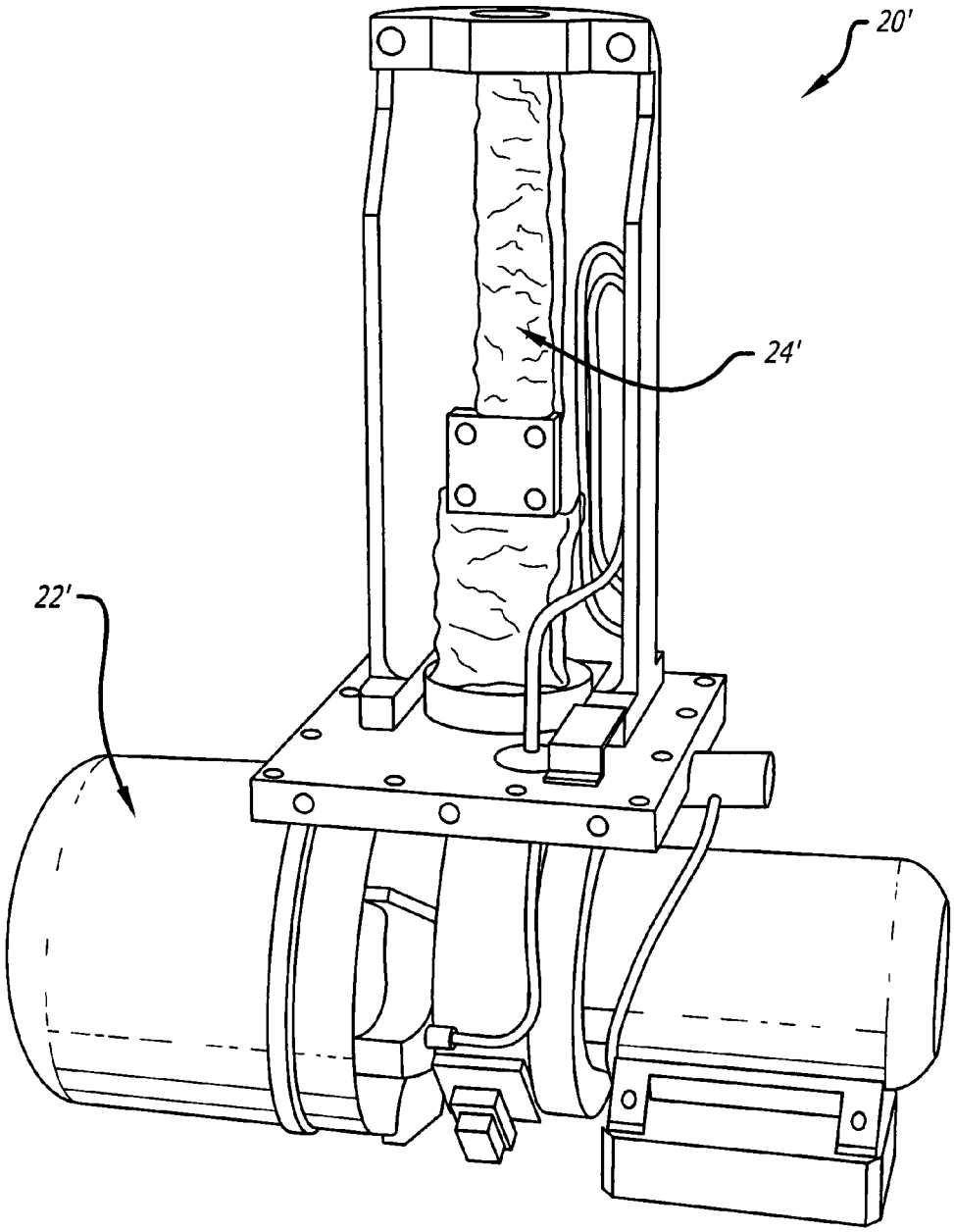
FIG. 2 (Prior Art)
FIG. 2 is a perspective view of a typical single-module Pulse-tube cryocooler implemented in accordance with conventional teachings.

FIG. 2 is a perspective view of a typical single-module Pulse-tube cryocooler 20' implemented in accordance with conventional teachings. Pulse-tube cryocoolers can be built as either a single-module system or a two-module system as per the Stirling-class cryocooler. In either case, the compressor portion of the system 22' closely resembles that of the Stirling-class machine. However, the expansion cycle is achieved through purely passive expander 24' in the pulse-tube type cryocooler 20'. This type of machine contains no moving parts aside from the compressor elements, and is hence much smaller and more lightweight than its Stirling counterpart. Additionally, the fewer number of motors present in the pulse-tube cryocooler requires less complex drive electronics.

While complicated and heavy relative to the pulse-tube system, the Stirling-class cryocooler has several advantages over the pulse-tube type system. Firstly, Stirling machines are typically more efficient than their pulse-tube counterparts, especially at temperatures below approximately 60° K. Single-stage Stirling machines can often be used at low temperatures that would require a multi-stage pulse tube type system.

Secondly, the actively driven piston in the Stirling machine allows for considerable system flexibility. That is, the pulse-tube system's operation is determined by the mechanical and thermodynamic design, neither of which can be easily changed after the cooler is constructed. Pulse-tube cryocoolers are therefore optimally configured for a single operating point (consisting of an ideal cold-tip temperature and heat load) and any deviation from this operating point will reduce the system efficiency.

In practice, the characteristics of most cryocooler applications vary over time and the cryocooler system is forced to operate at conditions differing from those for which it was optimized. A pulse-tube type system can suffer a significant reduction in efficiency and capacity in these cases and cannot easily be re-tuned for the new operation conditions. A Stirling machine with its actively driven displacer piston can be tuned to a very high degree, allowing it to remain efficient over a wide variety of operating conditions.

The central advantages of the pulse-tube type cryocooler are therefore low mass and volume, lessened mechanical complexity, and lessened electronics complexity in comparison to Stirling-class cryocoolers. The advantages of the Stirling-class cryocoolers are higher efficiency, higher capacity at low temperature, and the ability to tune the system to changing operational conditions.

Hence, an ideal cryocooler system would blend the advantages of both cryocooler types while eliminating their respective disadvantages. That is, the ideal machine would have the mass, volume, and overall complexity of a pulse-tube cryocooler while also having the Stirling-class cryocooler's thermodynamic and operational flexibility advantages. The efficiency, capacity, and tuning flexibility of the Stirling-class cryocooler can only be obtained through the use of an actively driven displacer piston, and so it seems unlikely that the displacer motor can be completely eliminated. It is possible, however, to combine the compressor and displacer motors into a single unit with two independently driven coils operating inside of a common magnetic circuit. This invention disclosure details a magnetic and mechanical design that accomplishes this task, allowing for the design of a Stirling-class cryocooler with greatly reduced mass, volume, and overall complexity.

Figure 4:
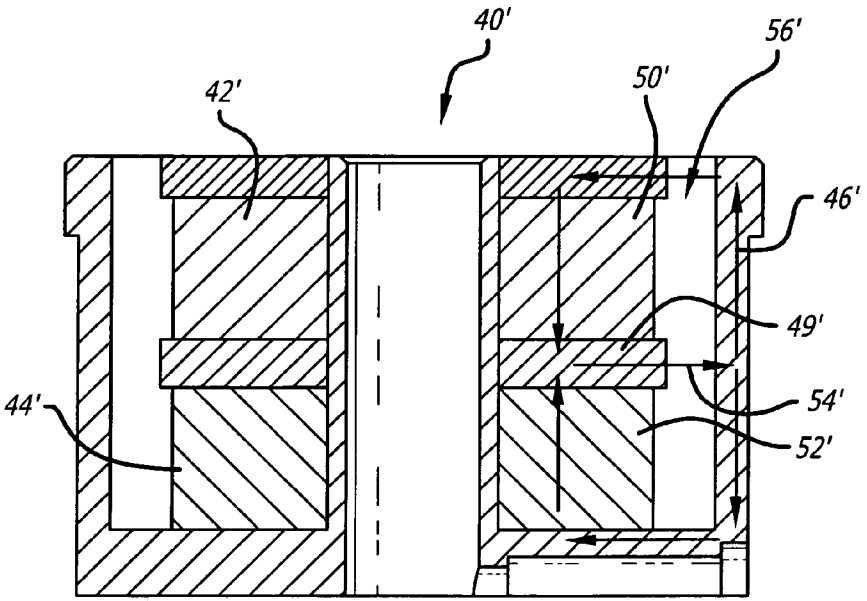
FIG. 4 (Prior Art)
FIG. 4 is a sectional side view of a typical cryocooler motor with two magnetic gaps in accordance with conventional teachings.
Figure 3:
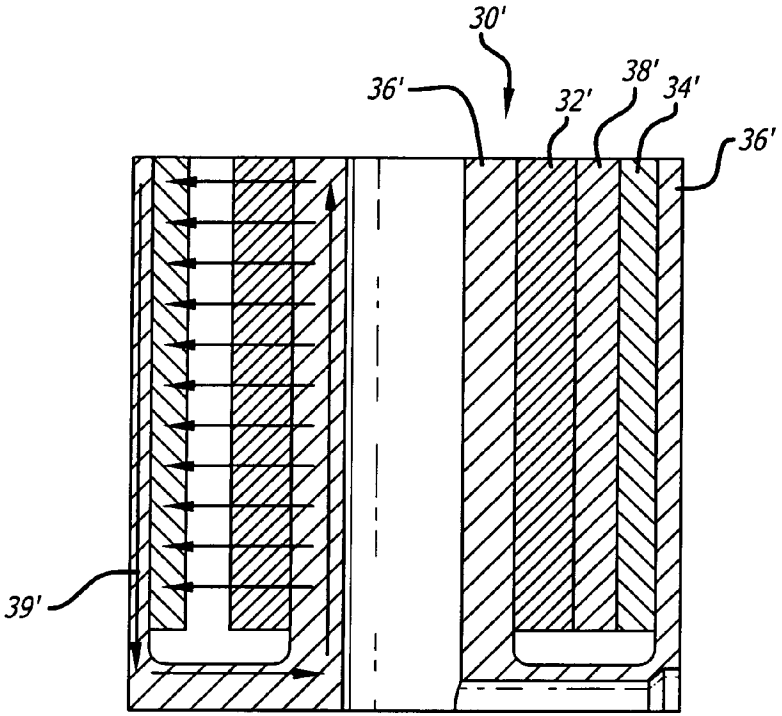
FIG. 3 (Prior Art)
FIG. 3 is a sectional side view of a typical cryocooler motor with a single magnetic gap in accordance with conventional teachings.

Two typical cryocooler motor magnetic circuits are illustrated in FIGS. 3 and 4. FIG. 3 is a sectional side view of a typical cryocooler motor with a single magnetic gap in accordance with conventional teachings.

FIG. 4 is a sectional side view of a typical cryocooler motor with a two magnetic gaps in accordance with conventional teachings. The arrows represent magnetic flux paths. In FIG. 3, the motor 30' contains a series of radially oriented magnets 32' and 34' that generate flux which travels through a magnetic conductor or 'backiron' 36' and over a single magnetic gap 38'. A motor coil (not shown) is disposed in the gap 38'. Note that the motor 30' is symmetric about the centerline thereof. The flux lines 39' are shown only on the left side for clarity while the magnets 32' and 34', gap 38' and backiron 36' are shown only on the right side thereof. The magnets are Neodymium Iron Boron, Samarium Cobalt (SmCo) or other suitable magnetic material.

The motor 40' shown in FIG. 4 is a more efficient design, with dual magnets 42' and 44' forcing a high amount of magnetic flux 46' through a central magnetic pole 49'. Again, the motor 40' is symmetric about the centerline thereof. Hence, the flux lines 46' are shown only on the right side while the magnets are labeled on the left for clarity. This type of motor actually contains two separate magnetic circuits, with the upper circuit 50' and lower circuit 52' sharing the central pole 49'. The lower magnetic circuit 52' therefore has a single magnetic gap 54' and the upper circuit 50' has two magnetic gaps 54' and 56'. Previously, this type of motor 40' has been used for high-efficiency designs because the magnetic flux density in the central magnetic gap 54' is higher than that of competing designs.

Figure 5:
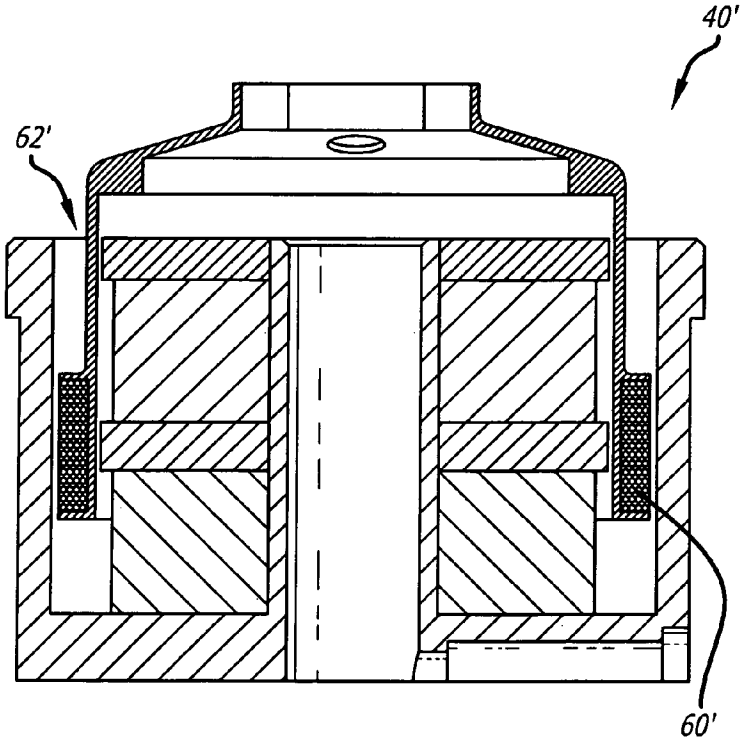
FIG. 5 (Prior Art)
FIG. 5 is a more complete sectional side view of the motor of FIG. 4, including a single motor coil and its associated bobbin.

FIG. 5 is a more complete sectional side view of the motor of FIG. 4. As shown in FIG. 5, typically, a drive coil 60' is placed in the central gap 54' with the coil former 62' rising through the upper gap 56' and attaching to its suspension (not shown).

The upper magnetic gap 56', having significantly lower flux density than the central gap 54' is often unused. In cases where it is used, an additional drive coil is wound on the main drive coil's bobbin and in the secondary gap. The coils are typically wired in series, with the upper coil contributing a small amount of additional drive force for a given amount of input current.

This invention teaches the use of the upper magnetic gap to drive an independently moving secondary coil that is wound on its own bobbin. See FIG. 6.

Figure 6:
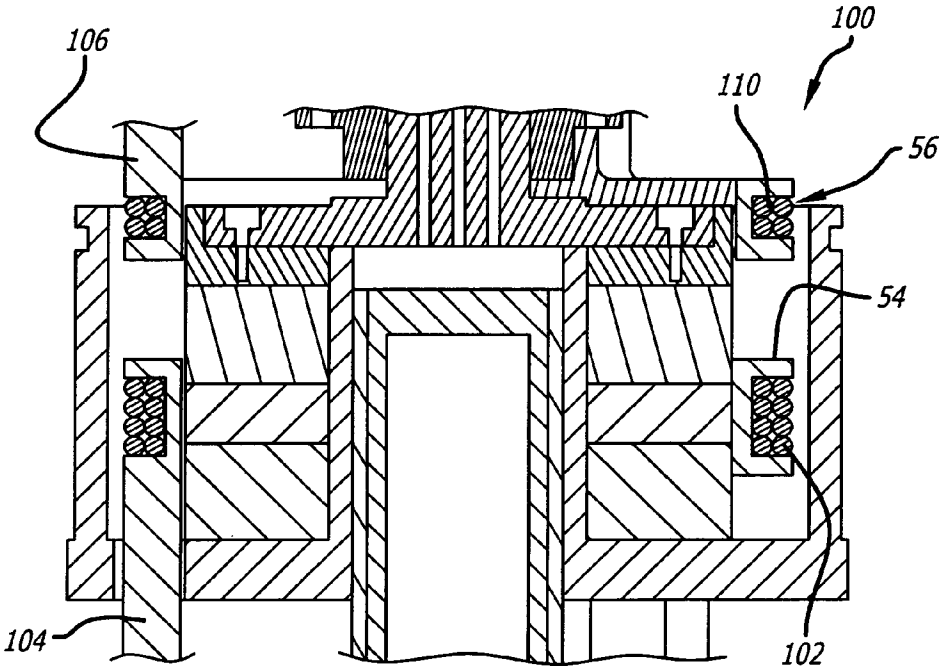
FIG. 6 is a sectional side view of a cryocooler motor with two independently driven magnetic coils in accordance with an illustrative embodiment of the present teachings.

FIG. 6 is a sectional side view of a cryocooler motor with a two independently driven magnetic coils in accordance with an illustrative embodiment of the present teachings. The cryocooler motor 100 of FIG. 6 is similar to that of FIG. 4 with the exception that in addition to the main drive coil 102 mounted in the first air gap 54, a second coil 110 is mounted in the second gap 56 thereof. The two coils are physically independent from each other and, when driven, are free to move independently. The first coil support bobbin 104 is shown on the left side and omitted on the right side for clarity. Likewise, the second coil's support bobbin 106 is shown on the left side of the figure and omitted on the right side for clarity.

Figure 7:
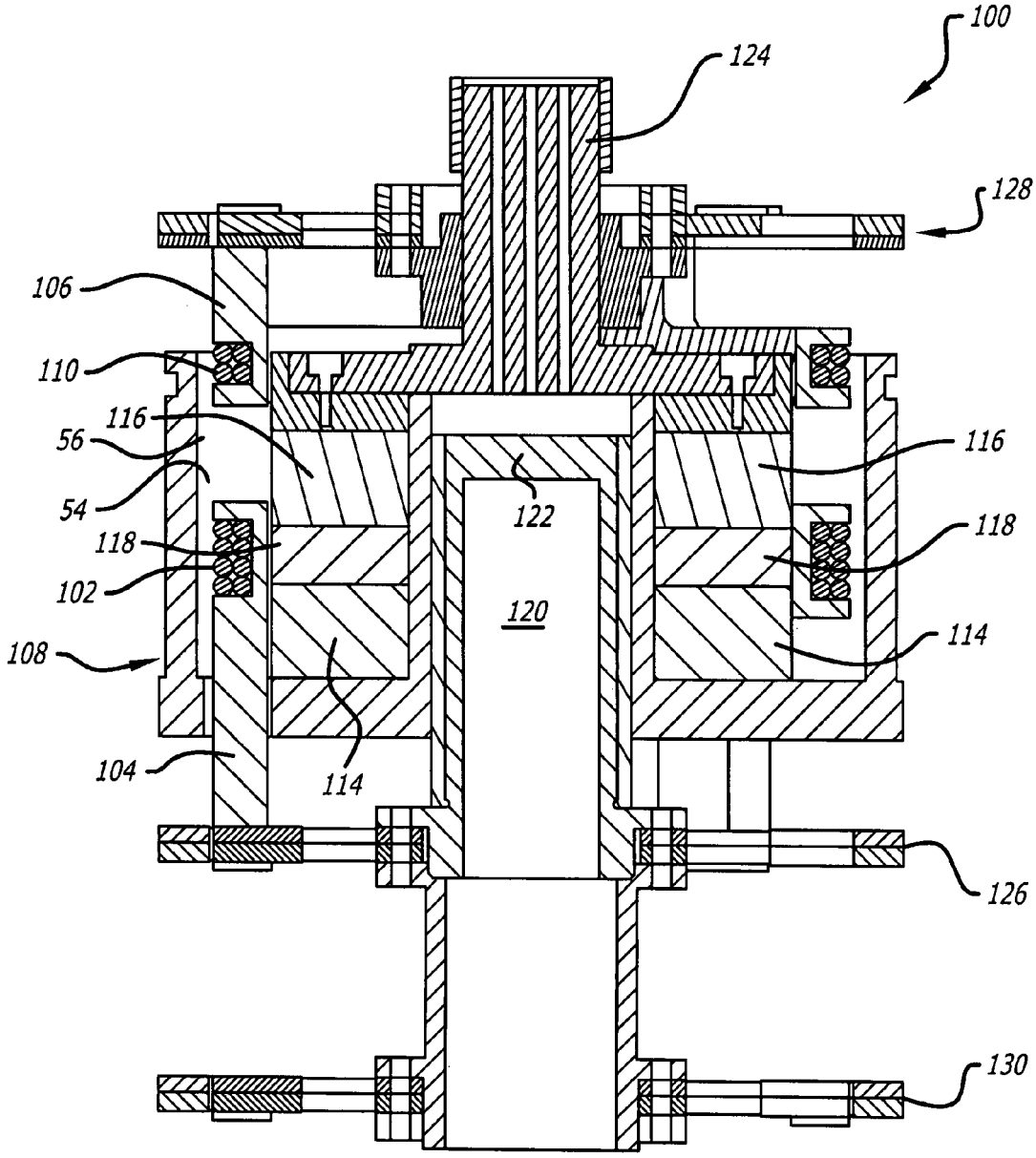
FIG. 7 is a more complete sectional side view of the cryocooler motor of FIG. 6.

FIG. 7 is a more complete sectional side view of the cryocooler motor of FIG. 6. As shown in FIG. 7, the motor 100 includes a cylindrical housing 108 within which first and second annular magnets 114 and 116 are disposed. The magnets generate a flux that travels within a magnetic circuit provided by a backiron 118 and the housing 108. In the illustrative embodiment, the housing 108 and backiron (magnetic return path) 118 are constructed with stainless steel and the magnets are Neodymium Iron Boron (NdFeB), Samarium Cobalt (SmCo) or other suitable magnetic material. Nonetheless, those skilled in the art will appreciate that the invention is not limited to the materials used in the illustrative embodiment.

As mentioned above, the flux travels within the magnetic circuit and across the first air gap 54 to interact with a field generated by a flow of current in the first coil 102. In the illustrative embodiment, the first coil 102 is a high-power primary (compressor) coil. However, the invention is not limited thereto. The interaction of the flux with the field generated by the coil induces a force between the housing and the first coil 102 and causes the coil 102 to move against a suspension element 126 through a bobbin 104. In the illustrative embodiment, the bobbin 104 has three poles that extend through the bottom of the housing 108.

In accordance with the invention, a second coil 110 is disposed in a second air gap 56 in the magnetic circuit around a second bobbin 106. The flow of current in the second coil generates a magnetic field that interacts with the flux flowing in the magnetic circuit and induces a force between the housing and the second coil 110. The bobbin 106 of the second coil 110 rises up and out of the motor 100 in order to connect to its suspension system 128. The projection of the first and second bobbins in opposite directions allows for independent movement of the coils without mechanical interference between each other.

In the illustrative embodiment, the secondary coil 110 is not as efficient as the main drive coil 102. However, this lack of efficiency has negligible impact on overall system efficiency if the secondary coil 110 is utilized to drive a low-power (relative to the compressor) Stirling displacer piston.

The coils 102 and 110 transfer motion to the first and second suspension elements 126 and 128. The first suspension element 126 subsequently couples motion to a compressor piston 120 disposed in a cylindrical chamber 122 provided within the housing 108. Gas compressed by the piston 120 is released through a gas transfer line 124 in a conventional manner. This gas transfer line is shown as a typical component, and those skilled in the art will understand that the inclusion of a gas transfer line is not strictly necessary to practice the invention. The housing is supported by a third suspension element 130.

Figure 8:
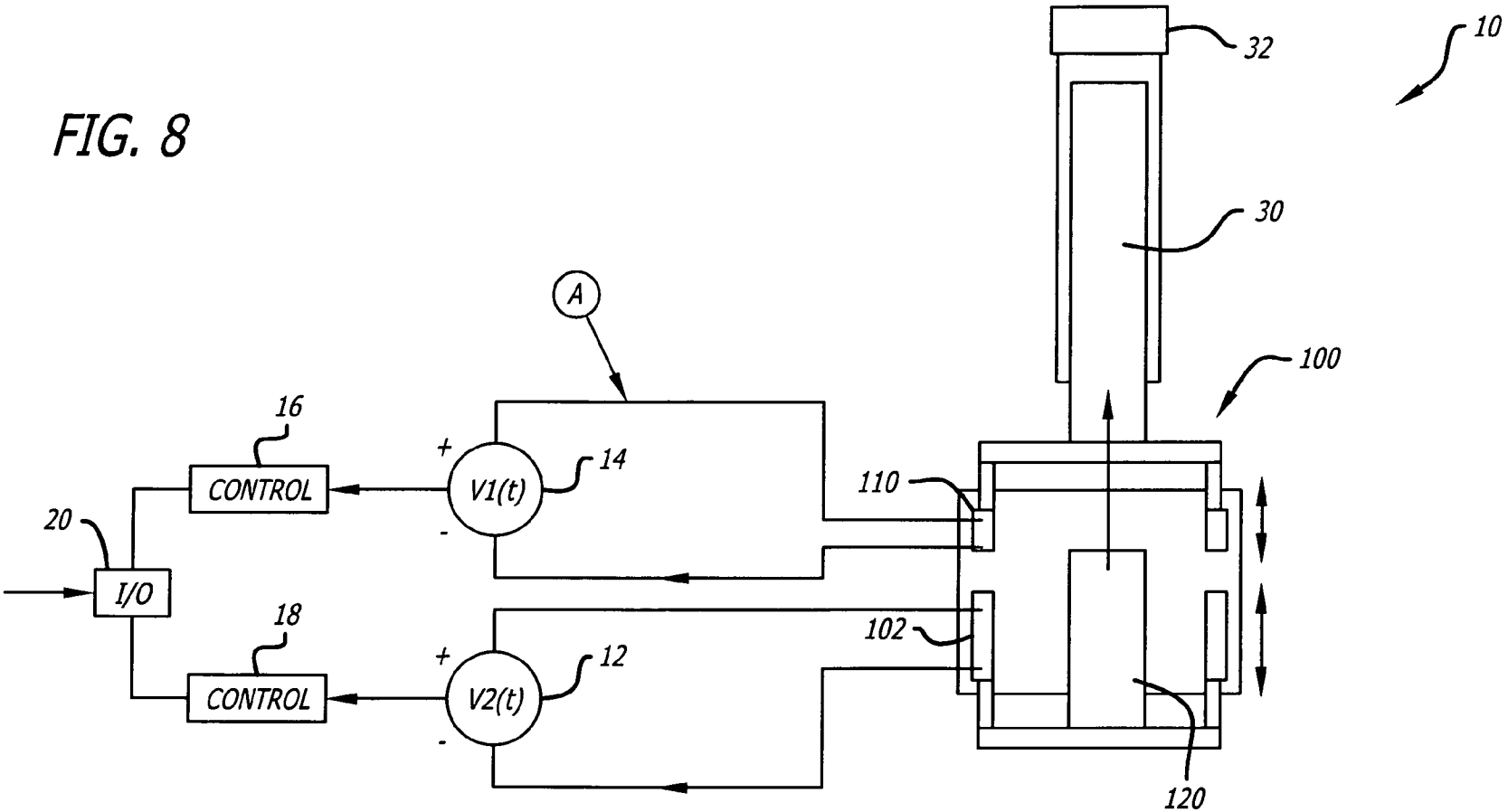
FIG. 8 shows a schematic of a single-module Stirling cycle cryocooler having a cryocooler motor with two independently driven motor coils in accordance with an illustrative embodiment of the present teachings.

FIG. 8 shows a single-module Stirling cycle cryocooler 10 having a cryocooler motor 100 with two independently driven magnetic coils in accordance with an illustrative embodiment of the present teachings. As shown in FIG. 8, the cryocooler 10 includes first and second variable power sources 12 and 14 that drive the first and second coils 102 and 110 in response to signals from first and second controller 16 and 18 respectively. The first and second controllers 16 and 18 are responsive to user input via an input/output interface 20. A Stirling displacer assembly 30 includes a piston that is driven by the second coil 110 of the motor. The displacer assembly 30 includes a regenerative heat exchanger and serves to displace gas compressed by the compressor piston 120, accomplishing the Stirling Thermodynamic cycle. A cold tip 32 is provided at a distal end of the assembly 30 as is common in the art.

Hence, the inventive motor has been disclosed herein as a single magnetic circuit used to drive the two independent coils, allowing for the elimination of the dedicated Stirling displacer magnetic circuit typical of most Stirling cryogenic coolers. This invention has implications beyond the obvious removal of a motor in a Stirling-class cryocooler. The placement of the compressor and displacer pistons on the same axis allows for both of their vibrations to be minimized with a single balancer motor on the same axis. This balancer would likely require its own magnetics and drive coil, though the total magnetics count for the whole cryocooler system would be only two as compared to four for a typical two-module Stirling cryocooler. Coil count is three as opposed to the typical four. System mass and volume are greatly reduced by the elimination of half of the typically required magnetic circuits and the drive electronics are substantially simplified by the elimination of one drive coil. Additionally, the whole Stirling system can now be packaged into a single module, further reducing system mass and volume.

The ability to package the Stirling compressor and displacer coils into a common magnetics assembly represents a large step forward in Stirling-class cryocooler development. This arrangement makes possible a very large reduction in system mass and volume, while also reducing drive electronics complexity. This invention will allow Stirling-class cryocoolers, with all of their inherent advantages, to compete directly with pulse-tube cryocoolers in terms of mass, volume, and overall complexity. The result is a machine that could be superior in most ways to current pulse-tube and Stirling-class cryocooler systems.

Thus, the present invention has been described herein with reference to a particular embodiment for a particular application. Those having ordinary skill in the art and access to the present teachings will recognize additional modifications applications and embodiments within the scope thereof. For example, while this disclosure has focused on applicability to single-stage Stirling cryocoolers, it is important to note that the invention is directly applicable to any type of cooler that employs both a compressor motor and a Stirling displacer motor. For instance, the Raytheon Stirling Pulse-Tube two-stage hybrid cryocooler ("RSP2") system makes use of a general motor layout that is virtually identical to that of typical single stage Stirling cryocooler (in effect, the RSP2 is a single-stage Stirling machine with a pulse-tube stage attached mechanically and thermodynamically to the cold end of the first Stirling stage).

The invention described herein is therefore applicable in a very straightforward way to the entire RSP2 series of cryocoolers. The invention can also be directly applied to other situations in which a relatively high-powered linear motor is in close proximity to a lower-powered linear motor. For instance, the "expander module" of a typical Stirling space cryocooler contains the displacer motor as well as another motor that is dedicated to balancing vibration that originates from the displacer. Current designs contain a magnetic circuit for each of these motors, however the invention described herein could be used in a straightforward way to eliminate one of the motors. The coils are energized with first and second variable sources of electrical energy in response to signals from a controller.

It is therefore intended by the appended claims to cover any and all such applications, modifications and embodiments within the scope of the present invention.

Accordingly,

What is claimed is:

1. A Stirling cycle cryogenic cooler comprising:

a first coil disposed in a first magnetic gap, the first coil coupled to a first suspension element, the first suspension element coupled to a compressor piston, the first coil configured to linearly drive the compressor piston using the first suspension element;

a second coil disposed in a second magnetic gap, the second coil coupled to a second suspension element, the second suspension element coupled to a displacer piston, the second coil configured to linearly drive the displacer piston, the second coil mounted for mechanically independent movement relative to the first coil; and a common magnetic circuit comprising first and second magnets having a common magnetic pole, the first magnet configured to generate a first field of magnetic flux that travels across the first magnetic gap and the second magnetic gap, the second magnet configured to generate a second field of magnetic flux that travels across the first magnetic gap and that does not substantially travel across the second magnetic gap, the first and second fields of magnetic flux of the common magnetic circuit interacting with the first coil and the first field of magnetic flux of the common magnetic circuit interacting with the second coil to allow the linear driving of the compressor piston and the displacer piston;

wherein the compressor piston and the displacer piston have a common axis; and wherein the first coil is larger than the second coil.

2. The Stirling cycle cryogenic cooler of claim 1, wherein:

the first coil is a compressor coil, and the second coil is a displacer coil.

3. The Stirling cycle cryogenic cooler of claim 1 wherein the first and second coils are wound on first and second bobbins, respectively.

4. The Stirling cycle cryogenic cooler of claim 1, wherein the first suspension element and the second suspension element project in opposite directions from a housing of the cryogenic cooler.

5. The Stirling cycle cryogenic cooler of claim 1, further comprising:

first and second variable power sources configured to energize the first and second coils, respectively.

6. The Stirling cycle cryogenic cooler of claim 5, further comprising:

at least one controller configured to send signals to manipulate the energizing by at least one of the first and second variable power sources.

7. A cooler comprising:

a compressor coil disposed in a first magnetic gap, the compressor coil coupled to a first suspension element, the first suspension element coupled to a compressor piston, the compressor coil configured to linearly drive the compressor piston using the first suspension element;

a displacer coil disposed in a second magnetic gap, the displacer coil coupled to a second suspension element, the second suspension element coupled to a displacer piston, the displacer coil configured to linearly drive the displacer piston, the displacer coil mounted to move independently relative to the compressor coil; and a common magnetic circuit comprising first and second magnets having a common magnetic pole, the first magnet configured to generate a first field of magnetic flux that travels across the first magnetic gap and the second magnetic gap, the second magnet configured to generate a second field of magnetic flux that travels across the first magnetic gap and that does not substantially travel across the second magnetic gap, the first and second fields of magnetic flux of the common magnetic circuit interacting with the compressor coil and the first field of magnetic flux of the common magnetic circuit interacting with the displacer coil to allow the linear driving of the compressor piston and the displacer piston;

wherein the compressor piston and the displacer piston have a common axis; and wherein the compressor coil is larger coil than the displacer coil.

8. The cooler of claim 7, wherein the compressor coil and the displacer coil are wound on first and second bobbins, respectively.

9. The cooler of claim 7, wherein the first suspension element and the second suspension element project in opposite directions from a housing of the cooler.

10. The cooler of claim 7, further comprising:

first and second variable power sources configured to, energize the compressor and displacer coils, respectively.

11. The cooler of claim 10, further comprising:

at least one controller configured to send signals to manipulate the energizing by at least one of the first and second variable power sources.

12. A cooling method comprising:

generating a first field of magnetic flux in a first magnetic gap and a second magnetic gap with a first magnet of a common magnetic circuit and generating a second field of magnetic flux in the first magnetic gap and not substantially in the second magnetic gap with a second magnet of the common magnetic circuit, the first and second magnets having a common magnetic pole;

compressing a fluid by selectively energizing a first coil in the first magnetic gap, the first coil interacting with the first and second fields of magnetic flux of the common magnetic circuit to linearly move a first suspension element and thereby drive a compressor piston to compress the fluid; and expanding the fluid by selectively energizing a second coil in the second magnetic gap, the second coil interacting with the first field of magnetic flux of the common magnetic circuit to linearly move a second suspension element and thereby drive a displacer piston to expand the fluid;

wherein the compressor piston and the displacer piston have a common axis; and wherein the first coil is larger than the second coil.

13. The cooling method of claim 12, wherein the compressing and expanding operate in a Stirling cycle.

14. The cooling method of claim 12, wherein the movement of the first suspension element and the second suspension element are in opposite directions from a housing of the cooler.

15. The cooling method of claim 12, wherein the first coil and the second coil are selectively energized by first and second variable power sources, respectively.

16. The Stirling cycle cryogenic cooler of claim 1, wherein, when the first and second fields of magnetic flux travel across the first magnetic gap, the first and second fields of magnetic flux induce a force between a housing of the cryogenic cooler and the first coil and cause the first coil to move against the first suspension element.

17. The Stirling cycle cryogenic cooler of claim 16, wherein, when the first field of magnetic flux travels across the second magnetic gap, the first field of magnetic flux induces a force between the housing and the second coil and causes the second coil to move against the second suspension element.

18. The Stirling cycle cryogenic cooler of claim 1, wherein:

when magnetic flux of the first and second fields of magnetic flux crosses the first magnetic gap, the magnetic flux of the first and second fields crosses the first coil, and when magnetic flux of the first field of magnetic flux crosses the second magnetic gap, the magnetic flux of the first field crosses the second coil.

19. The Stirling cycle cryogenic cooler of claim 1, wherein:

the common magnetic circuit comprises a plurality of magnetic circuits comprising a backiron magnet return path disposed between the first magnet and the second magnet, a first magnetic circuit of the plurality of magnetic circuits comprises the first magnet, the backiron magnet return path, the first magnetic gap, and the second magnetic gap, and a second magnetic circuit of the plurality of magnetic circuits comprises the second magnet, the backiron magnet return path, and the first magnetic gap.

20. The Stirling cycle cryogenic cooler of claim 19, further comprising a housing, wherein each of the first and second magnetic circuits further includes a portion of the housing.

* * * * *